United States Patent [19]

Caruso

[11] Patent Number: 4,513,667

[45] Date of Patent: Apr. 30, 1985

[54] HAND GRENADE SAFETY DEVICE

[76] Inventor: Anthony M. Caruso, 1620 Dallas St., Aurora, Colo. 80010

[21] Appl. No.: 554,782

[22] Filed: Nov. 25, 1983

Related U.S. Application Data

[63] Continuation-in-part of Ser. No. 418,758, Sep. 16, 1982, abandoned.

[51] Int. Cl.[3] ..... F42B 27/00

[52] U.S. Cl. ..... 102/487; 102/482

[58] Field of Search ..... 102/482–488, 102/368

[56] References Cited

U.S. PATENT DOCUMENTS 2,423,993 7/1947 Panter et al. ..... 102/483

FOREIGN PATENT DOCUMENTS 628604 10/1927 France ..... 102/482
344841 5/1937 Italy ..... 102/482
210626 11/1940 Switzerland ..... 102/482
125436 4/1919 United Kingdom ..... 102/482

*Primary Examiner*—Harold J. Tudor
*Attorney, Agent, or Firm*—Charles E. Baxley

[57] ABSTRACT

A different, or additional safety mechanism is provided for hand grenades and other munitions. Illustratively, a latch, pivotally mounted on the safety handle or explosive filling plug of a conventional fragmentation grenade immobilizes the otherwise free end of the grenade's safety handle. In this way, the ring and safety pin combination can be eliminated because the latch now provides an alternate safety. The latch also prevents the dangerous field abuse of carrying grenades from accouterment or uniforms by means of the safety handles or the safety pin rings.

4 Claims, 7 Drawing Figures

HAND GRENADE SAFETY DEVICE

This application is a continuation-in-part of original application having Ser. No. 418,758 and filing date of Sept. 16, 1982 now abandoned.

This invention relates to safety devices for hand grenades and other munitions and, more particularly, to a pivoted latch for restraining the movement of the safety handle, and the like.

The design of a fully satisfactory munition is an extremely difficult undertaking. This is especially apparent in trying to design small, personally carried munitions, of which hand grenades for fragmentation, smoke, chemical and pyrotechnic purposes are typical.

Among the usual requirements for an acceptable grenade—or any other munition, for that matter—are effectiveness, low cost, light weight, small size, simplicity, reliability and safety. A typical hand grenade arming and firing mechanism endeavors to satisfy these needs in a number of ways.

Ordinarily, an arming and firing mechanism for a hand grenade that characterizes the prior art has a stamped metal detonator fitting secured to the grenade casing. The fitting mounts an impact-sensitive detonator that, when activated, ignites a powder train which ultimately causes the grenade to explode, generate smoke, or the like.

The necessary impact is applied to the detonator through a spring-loaded hammer that is pivotally mounted on the detonator fitting. Thus, the force stored in the spring is released by driving the hammer from its "cocked" position through an arc of a circle to slam the hammer down on the detonator with sufficient force to activate the detonator and thereby to ignite the powder train.

A long, lever-like safety handle and safety pin combination keep the hammer "cocked" until release is desired. The safety handle also is spring loaded and pivoted to the detonator fitting. The safety pin, moreover, locks the safety handle to the detonator fitting until it is manually extracted or "pulled". Once the safety pin is "pulled", the safety handle is retained in place only through the manual force that results from the fingers which press the grenade casing and safety handle into the palm of the hand. Upon throwing the grenade, or otherwise releasing the grenade from this manual force, the safety handle flips away from the casing under the force of its own spring, freeing, in this way, the "cocked" hammer.

Although this foregoing technique for arming and firing hand grenades has been in use, in one form or another, for decades, it nevertheless suffers from a number of shortcomings when actually deployed in the field. Typically, inexperienced soldiers are in the habit of "pulling" the safety pin and throwing the safety pin away before the grenade is thrown. This is, of course, a bad practice should a "cease fire" order issue immediately after the safety pin is thrown away or should it be decided that the grenade is not to be thrown at all. In these circumstances, either a safety pin must be found and carefully inserted into its locking position between the safety handle and the detonator fitting, or the soldier must keep the grenade tightly within his grasp against the not inconsiderable spring forces mentioned above until the grenade can be either safely disposed of or a new safety pin can be found.

These prior art grenades also lend themselves to other undersirable practices in the field. Illustratively, to facilitate safety pin extraction, a large diameter finger ring is secured in one exposed end of the safety pin. By inserting one or two fingers in this ring and drawing the ring away from the detonator fitting, the safety pin can be extracted. The unfortunate pratice, however, of securing one or more grenades to the tactical webbing of a soldier by means of these rings is occasionally noted. Clearly, a combination of body movement and contact with the ground can produce an unplanned extraction of the safety pin with attendant tragic results.

In a similar manner, the bad practice also is noted of hooking one or more grenades to the webbing by slipping the safety handle into the webbing rings or into the breast pockets of the usual combat fatigue uniform. The likelihood of an inadvertent grenade detonation as a consequence of this practice also is quite high.

The usual methods of military training, supervision and discipline are frequently not sufficient to stop these dangerous abuses. Consequently, there is a need to provide an inexpensive and reliable safety mechanism for hand grenades and other munitions that will permit the device to be restored to a "safe" status if the safety pin cannot be reinserted and that will prevent the safety handle from being misused.

In accordance with the invention these difficulties are overcome, to a great extent, by mounting a pivoted safety latch to selectively engage and disengage the safety handle with the casing of the munition.

More specifically, an explosive charge filling plug that is threaded, or otherwide secured in the end of the hand grenade that is opposite to the detonator fitting has, on its exposed surface, a hinge. One end of a latch is pivotally mounted on this hinge. The other extreme end of the latch terminates in a detent that engages the end of the safety handle and prevents the safety handle from pivoting away from the casing to enable the "cocked" hammer to activate the detonator.

This latch can be used with or without the conventional safety pin and ring arrangement. In either situation, the grenade is armed by manually pressing the latch away from the handle to disengage the detent from the safety handle. The safety pin, if the device is so equipped, then may be extracted and discarded with impunity. To place the armed grenade in a "safe" status, it is only necessary to reengage the latch with the safety handle to retain the hammer in its "cocked" status.

The latch, by bridging across the gap between the safety handle and the grenade casing, renders the practice of carrying the grenade on military accounterment or clothing by means of this handle impractical.

For those grenades that utilize both the latch that characterizes this invention and the safety pin and ring combination, the dangerous habit of securing the grenade to the solider's person by means of that ring becomes less likely to produce a chance detonation. Thus, not only are there two operative safety devices (the safety pin and the latch), but also to disarm both safety devices through body motion and contact with some other surface would require an awkward and forceful movement in the directions of several axes at the same time. Of course, should the hand grenade use only the latch mechanism that characterizes this invention, this problem will be eliminated because there is no ring from which the grenade can be suspended.

An alternate embodiment of the invention pivotally joins the latch to the free end of the safety handle. The end of the latch that extends across the base of the grenade, however, is joined to the base by means of a snap fastener, detent, or the like. The latch in this latter embodiment of the invention, moreover, may be either rigid or flexible, being fashioned, for example of metal, plastic or a suitably strong fabric. Preferably the snap fastening is accomplished by forcing an aperture in the fabric over a split post in the base of the grenade. The wings of the split post bend inwardly for releasing the fabric by allowing the aperture to slide over the wings of the pin. A slide is positioned on the latch, the slide having a tooth which moves between the wings of the split post so as to prevent inward defamation of the wings at the head of the post, and thereby prevent release of the fabric. The slide is readily withdrawn to permit release of the latch.

In this way, the latch mechanism that exemplifies the invention meets the criteria of low cost, simplicity, light weight and safety that are required of a fully satisfactory munition much better than other devices that have been advanced in the prior art. Accordingly, for a more complete appreciation of the invention, attention is invited to the following detailed descriptions of preferred embodiments thereof. The scope of the invention is limited, however, only through the claims.

DESCRIPTION OF THE PREFERRED EMBODIMENTS

Figure 1:
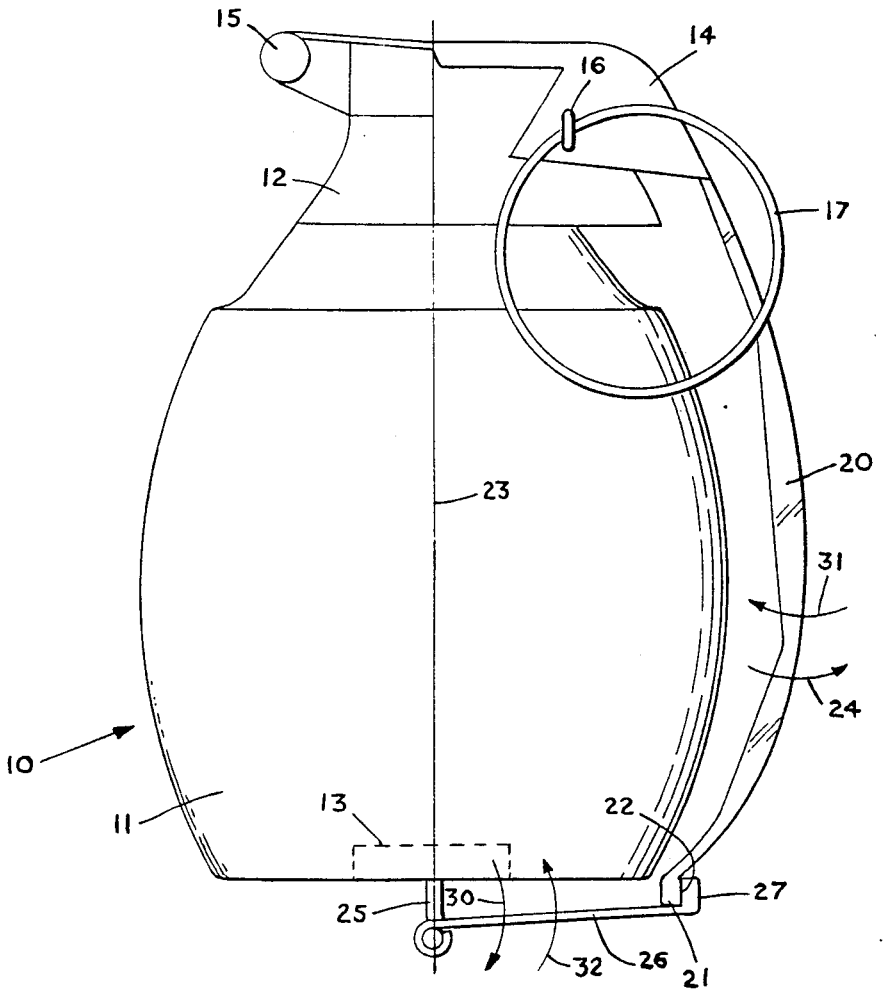
FIG. 1 of the drawings is a front elevation of a munition that embodies princiles of the invention.

A fragmentation hand grenade 10 that illustrates features of the invention is shown in the drawing. As illustrated, the grenade 10 has a fragmentation casing 11 one end of which is sealed by means of a detonator fitting 12. The opposite end of the grenade 10 is closed with an explosive charge filling plug 13 that will be described subsequently, in more complete detail.

A safety handle 14 is temporarily joined to the fitting 12 by means of a pivot 15, that is formed integrally with the fitting, and a safety pin 16. The pin 16 transfixes both the fitting 12 and the safety handle 14 through mutually aligned apertures (not shown in the drawing) in both the fitting and in the handle. A ring 17 having a diameter sufficiently great to accommodate one or more human fingers is joined to the safety pin 16 to permit the pin to be extracted by pulling the pin in a direction toward the viewer and perpendicular to the plane of the drawing.

The safety handle 14, in the position shown in the drawing, restrains the spring biased hammer (not shown) that is mounted within the fitting 12 in a "cocked" condition and thereby arrests the previously described sequence of events that lead to detonation.

In accordance with a salient aspect of the invention, the safety handle 14 has an arcuate tang 20 that is spaced from but generally matches the shape of the adjacent portion of the grenade casing 11. The extreme tip of the tang 20, however, extends somewhat beyond the end of the casing 11 that is opposite to that end in which the detonator fitting 12 is secured. As noted, this end of the tang 20 forms a small catch 21. The catch 21 provides a bearing surface 22 that is generally parallel with longitudinal axis 23 of the grenade 10.

A safety handle spring (not shown) urges the safety handle 14 in the direction of an arrow 24. The effect of the pivot 15 to which the handle 14 is hinged and the safety pin 16, however, is to restrain motion in the direction of the arrow 24.

Continuing with the description of the invention, a safety hinge 25 protrudes from the outside surface of the explosive fitting plug 13 in general alignment with the longitudinal axis 23. A latch 26, hinged on one end to the safety hinge 25, extends in a direction generally perpendicular to the longitudinal axis 23 across the adjacent end of the grenade casing 11 from which it is longitudinally spaced. As shown in the drawing, the latch 26 also crosses the gap between the grenade casing 11 and the tang 20. A detent 27, illustrated as a short stub that is perpendicular to the latch 26 and oriented generally in the direction of the axis 23 toward the detonator fitting 12, is pressed in frictional engagement with the bearing surface 22 of the catch 21. The friction force provided by the safety handle spring (not shown) that presses the safety handle 14 in the direction of the arrow 24 is sufficient to maintain a suitable sturdy connection between the latch 26 and the tang 20.

In operation, to arm the hand grenade 10, the latch 26 is manually pressed in the direction of arrow 30 to pivot away from the tang 20 about the safety hinge 25 in order to disengage the detent 27 from its contact with the bearing surface 22. To facilitate this movement of the latch 26, and depending upon the strength of the individual and the relative forces involved, it might be preferable to squeeze the catch 21 toward the casing 11 in the direction of arrow 31 in order to more readily manipulate the latch 26.

To complete arming a grenade that also is equipped with the safety pin 16 and the associated ring 17, the ring 17 is grasped and pulled in the direction of the viewer to extract the pin 16 from its illustrated position in which the pin joins the safety handle 14 to the detonator fitting 12. The grenade 10 is now armed and can be thrown. If it is decided, nevetheless, not to throw the grenade 10, the tang 20 is just pressed in the direction of the arrow 31. The latch 26 also is swung about the safety hinge 25 in the direction of arrow 32 in order to reengage the detent 27 with the catch 21. The force of the safety handle spring (not shown), pressing in the direction of the arrow 24 generates sufficient force to frictionally retain the latch 26 in safety engagement with the catch 21 on the safety handle 14.

Consequently, the latch 26, obstructing the gap between the grenade casing 11 and the tang 20, prevents the tang from being misapplied as a means for suspending the grenade 10 from combat webbing and fatigue uniform pockets. As stated above, the latch 26 also provides a further safety device to guard against an unplanned withdrawal of the safety pin 16 or as a means for eliminating any need for the safety pin.

In some circumstances it also might be desirable to spring load the latch 26 in order to provide a force that constantly urges the latch in the direction of the arrow 32.

Figure 2:
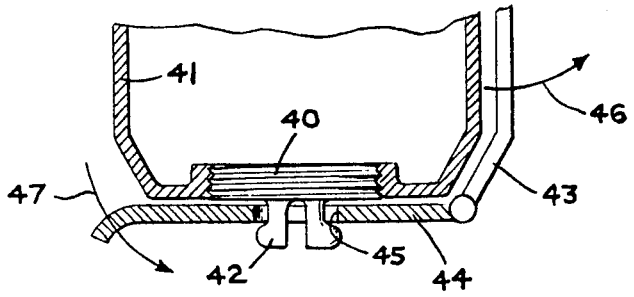
FIG. 2 is a view in full section of a munition that features an alternate embodiment of the invention.

Attention now is invited to the alternate embodiment of the invention that is shown in FIG. 2. As illustrated, filler plug 40 in the base of hand grenade casing 41 is provided with a protruding detent 42.

Safety handle 43 has fastened as its free end, a latch 44. The latch 44, moreover, is provided with an aperture 45 that snaps over, or engages the detent 42 to selectively restrain the safety handle 43 from motion in the direction of arrow 46.

In operation, when it is desired to arm the grenade that characterizes the embodiment of the invention shown in FIG. 2 it is only necessary to press the safety handle 43 slightly toward the grenade casing 41 in order to free the latch 44 from the detent 42. The latch 44 may then be pivoted away from the base of the grenade in the direction of arrow 47 to premit the safety handle 43 to spring in the direction of the arrow 46 when the grenade is thrown after safety pin extraction (not shown in the drawing), if a safety pin is indeed used.

Although the latch 44 in the embodiment of the invention that is shown in FIG. 2 is of rigid metal, plastic or other suitable material, a strong flexible material, e.g. cotton webbing, also can be used for this structural element.

To place the grenade that is shown in FIG. 2 on safe, it is only necessary to pivot the latch 44 back toward the base of the grenade and fit the detent 42 through the aperture 45. Manual pressure on the safety handle 43 is released and the spring forces that press the safety handle in the direction of the arrow 46 form a sturdy and rigid connection between the latch 44 and the detent 42.

Thus, in accordance with the invention, there is provided improved safety mechanisms for munitions and, in particular, for hand grenades.

With yet a further feature of the invention, additional safety is provided by means of a slide movable along the latch for engagement with the detent as will now be described.

Figure 3:
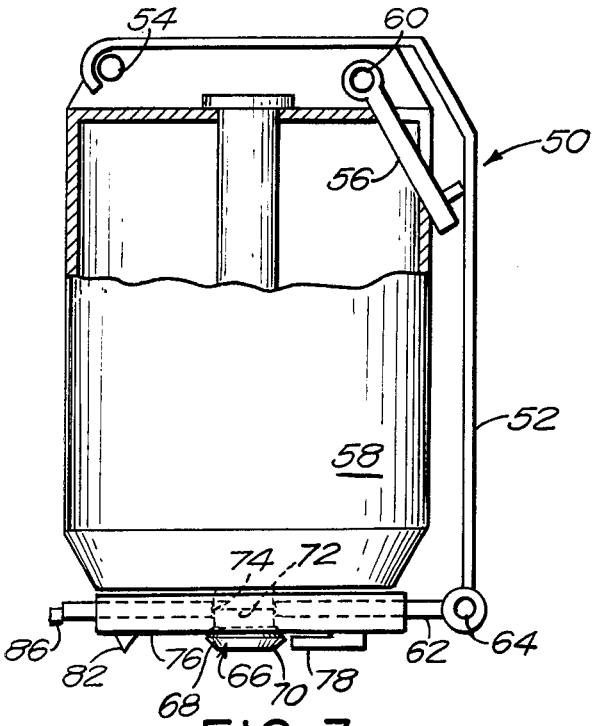
FIG. 3 is a side elevation view, partially cut away to show the interior portions, of a hand grenade having an alternative configuration to that shown in FIG. 1.
Figure 4:
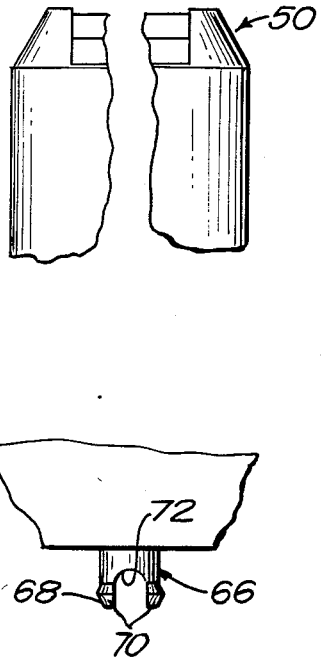
FIG. 4 is an end view of the grenade of FIG. 3.

With reference to FIGS. 3 and 4, there is shown an alternative embodiment of a grenade, this embodiment being identified by the legend 50 having a handle 52 formed as a safety lever which pivots about a hinge 54 at the top of the grenade 50. A spring-loaded striker 56 is retained in the inactive position by the handle 52, when the latter is closed against the case 58 of the grenade 50. For activation of the grenade 50, the handle 52 is allowed to swing away from the case 58 so as to free the striker 56. The striker 56 then rotates about a shaft 60 to activate the firing mechanism.

At the free end of the handle 52 there is secured a latch 62 by means of a hinge 64. The latch 62 may be constructed of the same material and in substantially the same form as the latch 44, previously described with reference to FIG. 2. A post 66 protrudes from the bottom of the grenade 50, a post terminating in a head 68 which is bifurcated into two wings 70 by a slot 72. The configuration of the post 66 is similar to that of the detent 42 of FIG. 2. The latch 62 is provided with an aperture 74 which fits over the head 68 upon attachment of the latch 62 to the post 66.

Figure 5:
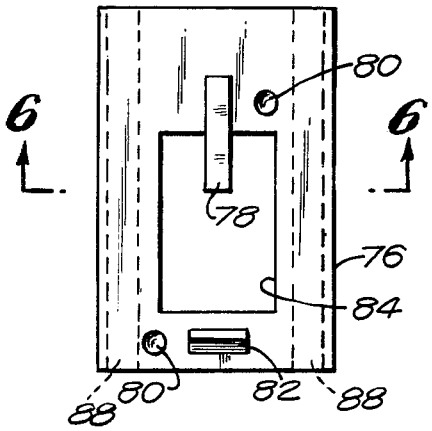
FIG. 5 is a plan view of a slide used for securing a latch with the grenade of FIG. 3.
Figure 7:
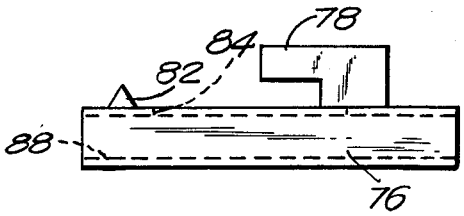
FIG. 7 is a side elevation view of the slide of FIG. 5.
Figure 6:
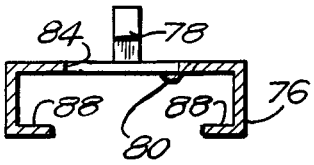
FIG. 6 is a sectional view of the slide taken along the line 6—6 in FIG. 5.

With reference also to FIGS. 5–7, there is shown a slide 76 which rides upon the latch 62 and includes a protruding tooth 78 which enters the slot 72 upon a translation of the slide 76 along the latch 62. Raised dimples 80 may be provided on the body portion of the slide 76 for more secure engagement with the latch 62. Also, a portion of the body of the slide 76 may be raised in the form of a thumb grip 82 to facilitate the displacement of the slide 76 by means of contact with the thumb of a person using the grenade 50. The amount of translation is limited by a rectangular aperture 84 which envelops the post 66, the dimensions of the aperture 84 being sufficiently large to permit the entry and egress of the tooth 78 into the slot 72 during translation of the slide 76 along the latch 62. A hook 86 (shown in FIG. 3) is formed advantageously at the free end of the latch 62 after attachment of the slide 76 to the latch 62; the hook 86 prevents loss of the slide 76 from the latch 62 at such times as when the latch 62 has been disengaged from the post 66 in preparation for activation of the grenade 50. Thereby, the slide 76 is always present for reengagement with the post 66 in a situation such as, for example, when it is later determined that the grenade 50 is not to be deployed.

In operation, the handle 52 is secured by pressing the aperture 74 of the latch 62 over the head 68 of the post 66 for securing the latch 62 to the post 66. As shown in FIG. 4, the wings 70 protrude outwardly to a greater extent than the balance of the post 66, this protrusion engaging with the sides of the aperture 74 of the latch 62. During a forcing of the latch 62 with its aperture 74 across the head 68, the wings 70 deflect inwardly to permit passage of the latch 62 across the head 68. Upon removal of the latch 62 from the post 66, the wings 70 again deflect inwardly to permit passage of the latch 62 across the head 68. The spring force within the wings 70 serves to retain the latch 62 in position on the post 66. Peripheral edges of the slide 76 parallel to the edges of the latch 62, are formed as channels 88 (FIG. 6) for engaging the edges of the latch 62 and for guiding the slide 76 along the latch 62.

The invention provides for yet further security by use of the slide 76, employment of the slide 76 providing for the insertion of the tooth 78 in the slot 72, so as to prevent the inward excurison of the wings 70 during passage of the latch 62 across the head 68. Thereby, with the tooth 78 in position in the slot 72, the latch 62 cannot be slid over the head 68. Thereby, the slide 76 provides additional security in retaining the latch 62 in position on the post 66.

It is to be understood that the above-described embodiments of the invention are illustrative only, and that modifications thereof may occur to those skilled in the art. Accordingly, this invention is not to be regarded as limited to the embodiments disclosed herein, but is to be limited only as defined by the appended claims.

I claim:

1. A safety mechanism for a hand grenade comprising a casing, a detonator fitting secured to one end of said casing, as safety handle mounted on said detonator fitting, a latch extending across the other end of said casing, and pivotally connecting an outer end of said handle, a detent engaging said latch in order to immobilize said safety handle relative to said grenade casing in order to provide a safety mechanism for the hand grenade;

said detent comprising a post protruding from the bottom of said casing and in alignment with said latch, the outer terminus of said post being formed as an enlarged head, said head being bifurcated into two resilient wings by a slot disposed along an axis of said post;

said latch having an aperture for engagement with said post, said head being oversized relative to said aperture to provide for an inward deflection of said wings into said slot during a passage of said latch aperture over said head; and wherein said mechanism further comprises a slide translatably mounted on said latch for movement in a direction generally parallel with the bottom of said casing for engagement with said post, said slide including a tooth in alignment with and oriented for insertion within said slot in a direction generally parallel with the bottom of said casing to prevent said wing deflection, thereby retaining said latch on said post.

2. A safety mechanism according to claim 1 wherein said slide includes an aperture disposed about said post for limiting the amount of translation of said slide.

3. A safety mechanism according to claim 2 wherein said slide extends across the bottom of said casing to facilitate manual grasping of the slide, said slide including a finger grasp extending away from said casing and disposed on an end of said slide opposite said tooth to facilitate manual translation of said slide.

4. A safety mechanism according to claim 3 wherein peripheral edges of said slide are formed as channels for engaging the edges of said latch, thereby to secure said slide to said latch.

* * * * *

UNITED STATES PATENT AND TRADEMARK OFFICE

CERTIFICATE OF CORRECTION

PATENT NO. : 4,513,667

DATED : April 30, 1985

INVENTOR(S) : Anthony M. Caruso

It is certified that error appears in the above-identified patent and that said Letters Patent are hereby corrected as shown below:

Column 6, line 52, (Claim 1, line 3) the word "as" should read --a--.

Signed and Sealed this

*First* Day of *April 1986*

[SEAL]

*Attest:*

DONALD J. QUIGG

*Attesting Officer*

*Commissioner of Patents and Trademarks*